US009254556B2

(12) United States Patent
Ou

(10) Patent No.: US 9,254,556 B2
(45) Date of Patent: Feb. 9, 2016

(54) SOCKET

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 247 days.

(21) Appl. No.: 14/068,995

(22) Filed: Oct. 31, 2013

(65) Prior Publication Data

US 2015/0114186 A1 Apr. 30, 2015

(51) Int. Cl.
*B25B 13/06* (2006.01)

(52) U.S. Cl.
CPC ..... *B25B 13/06* (2013.01)

(58) Field of Classification Search
CPC ..... B25B 13/06
See application file for complete search history.

(56) References Cited

U.S. PATENT DOCUMENTS 4,328,720 A * 5/1982 Shiel ..... B25B 13/06 81/124.6
4,535,658 A * 8/1985 Molinari ..... B25B 23/0035 81/177.85
5,626,062 A * 5/1997 Colvin ..... B25B 13/06 81/177.85
D425,385 S * 5/2000 Jarvis ..... D8/29
7,000,504 B2 * 2/2006 Chen ..... B25B 23/0035 81/60
7,104,163 B2 * 9/2006 Hu ..... B25B 13/06 81/121.1
8,359,953 B2 * 1/2013 Lin ..... B25B 13/06 81/121.1
8,459,151 B2 * 6/2013 Wang ..... B25B 13/107 81/124.3
8,475,076 B2 * 7/2013 Yamashita ..... B25B 13/06 403/322.2
2011/0146461 A1 * 6/2011 Yamashita ..... B25B 13/06 81/124.6
2014/0013905 A1 * 1/2014 Li ..... B25B 13/06 81/124.4
2014/0144295 A1 * 5/2014 Chang ..... B25B 13/56 81/124.4

* cited by examiner

*Primary Examiner* — David B Thomas

(57) ABSTRACT

A socket is adapted for being disposed in a sleeve hole of a wrench wherein the sleeve hole has a positioning element disposed on an inner wall of the sleeve hole. The socket includes a main body having a driving portion and a connecting portion at two ends. The connecting portion has a polygonal external surface including plural driven faces arranged around an axial direction. A shared edge is formed between every two adjacent driven faces, and at least one shared edge is formed with a notch for receiving the positioning element. The notch has a triangle cross-section and has a steeper first bottom face and a second bottom face which is more remote from the driving portion than the first bottom face. Thus, the socket can be prevented from moving forward and is easier to remove.

5 Claims, 4 Drawing Sheets

SOCKET

BACKGROUND OF THE INVENTION

1. Field of the Invention

The present invention relates to a socket, more especially to a socket for go-through wrenches.

2. Description of the Prior Art

To operate, a conventional go-through ratchet wrench is connected with a tool via a socket or a connector. To position the socket to the wrench, an elastic element is usually disposed on the inner wall of the sleeve hole of the wrench, and the outer wall of the socket is formed with a notch or a groove corresponding to the elastic element. When the elastic element is received in the notch, the socket can not be moved with respect to the wrench temporally for stability during operation. However, as shown in patents TW I232150, TW I245688, and U.S. Pat. No. 5,295,422, the notch of a conventional socket has two symmetrical walls. The two walls are inclined symmetrically. In TW I245688, the cross-section of the notch is square. That is, the two walls of the notch are also symmetrical and are perpendicular to the axial direction of the socket.

One of the walls of the notch is adapted for blocking the elastic element to prevent it from moving further, and the other wall serves as a guiding face to help the elastic element leaving the notch when the socket is going to be removed from the wrench. That is to say, one of the walls plays a role of blocking, and the other wall plays a role of diminishing blocking. If the walls slope too gently, the wall can not block the elastic element well. However, if the walls are too steep, the elastic element is difficult to be guided to leave the notch.

SUMMARY OF THE INVENTION

The main object of the present invention is to provide a socket which is able to be positioned in a go-through wrench without further moving forward and to facilitate removing.

To achieve the above and other objects, a socket of the present invention includes a main body and is adapted for received in a sleeve hole of a go-through wrench wherein the sleeve hole has a receiving portion on an inner wall thereof and a positioning element disposed in the receiving portion.

The main body has a driving portion and a connecting portion at two opposite ends along an axial direction. The driving portion is adapted for connecting a tool. The connecting portion has an external surface which is polygonal, and the external surface includes a plurality of driven faces arranged around the axial direction. A shared edge is formed between every two adjacent driven faces, and at least one shared edge is formed with a notch. When the connecting portion is received in the sleeve hole of the wrench, the positioning element is received in the notch for positioning the socket.

Specifically, a cross-section, which is parallel to a radial direction of the main body, of the notch is substantially triangle. An inner wall of the notch includes a first bottom face and a second bottom face connecting with each other wherein the first bottom face is closer to the driving portion than the second bottom face. An angle between the first bottom face and the adjacent shared edge is defined as a first angle, and an angle between the second bottom face and the adjacent shared edge is defined as a second angle. The first angle is larger than or equal to 90 degrees and smaller than the second angle. Each of the first angle and the second angle is smaller than 180 degrees.

Thereby, the bottom face of the notch facing the driving portion is less steep so as to facilitate removing the socket, and the bottom face of the notch opposite to the driving portion is steeper so as to abut against the positioning element to prevent the socket moving forward. Also, the socket can be prevented from moving with respect to the wrench.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
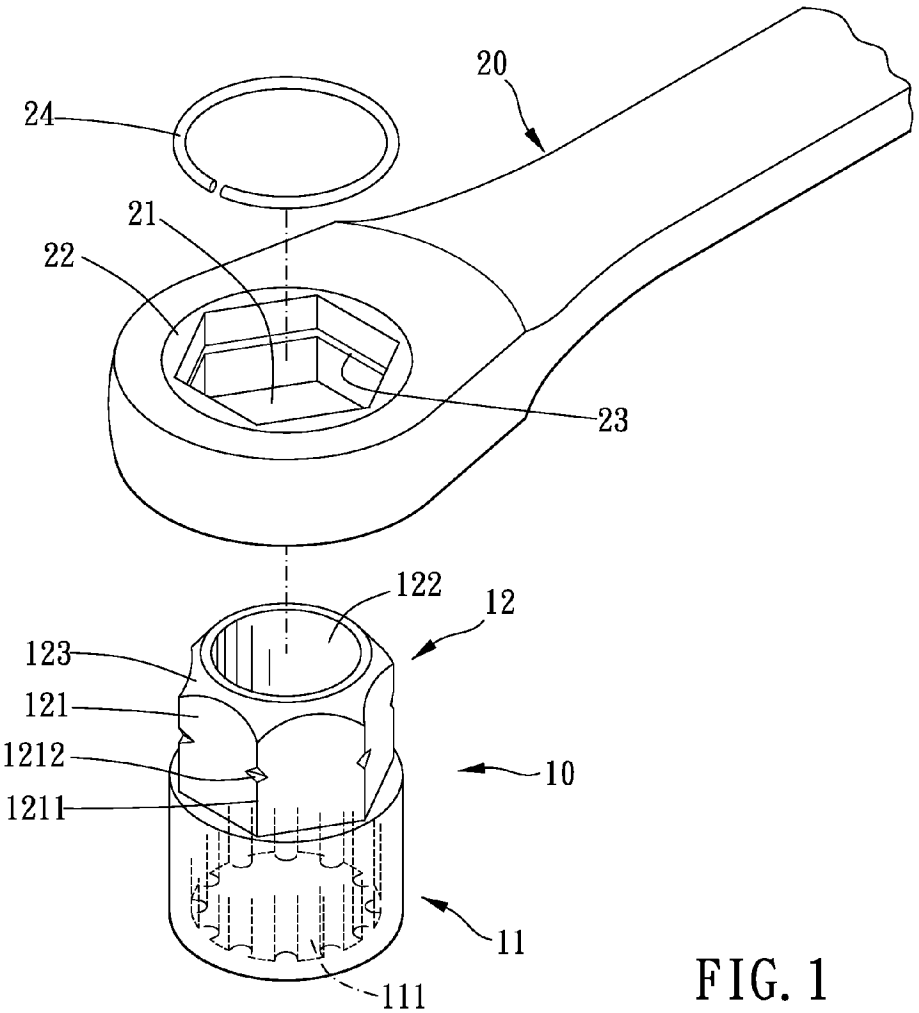
FIG. 1 is a breakdown drawing of the present invention.
Figure 2:
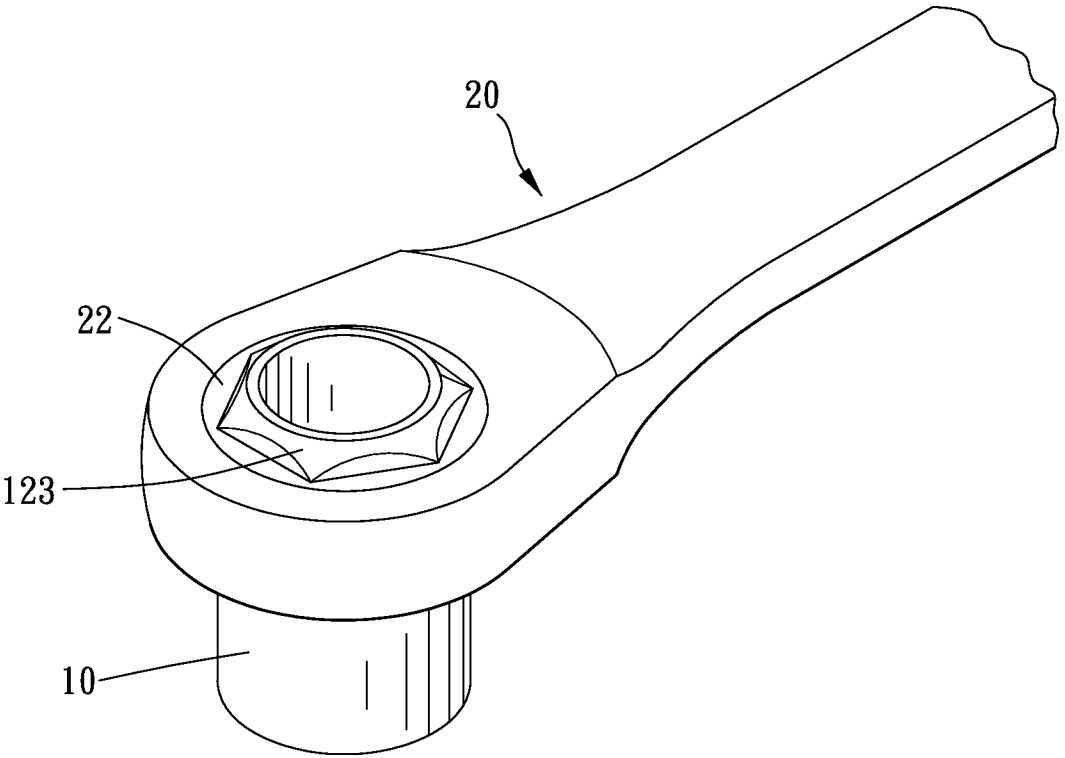
FIG. 2 is a stereogram of the present invention.

Please refer to FIG. 1 to FIG. 4 for a major embodiment of the present invention. The socket of the present embodiment includes main body 10. The main body 10 has a driving portion 11 and a connecting portion 12 at two ends along an axial direction. The driving portion 11 is adapted for connecting with a tool. In the present embodiment, the driving portion 11 includes a driving hole 111 extending along the axial direction for a tool to insert in. However, the driving portion can have other structure for connecting with tools, such as a polygonal protrusion. The connecting portion 12 has an external surface which is polygonal. The external surface includes a plurality of driven faces 121 arranged around the axial direction wherein the driven faces 121 are linked together to for the polygonal external surface. Preferably, an inclined chamfered face 123 is formed on an end of the external surface away from the driving portion 11 so that an end of the connecting portion 12 away from the driving portion 11 has reduced diameters. On the other hand, a shared edge 1211 is formed between every two adjacent driven faces 121, and at least one of the shared edges 1211 is formed with a notch 1212. When the connecting portion 12 is received in a sleeve hole 21 of a go-through wrench 20, a positioning element 24 disposed on an inner wall of the sleeve hole 21 is received in the notch 1212 for positioning the socket. Besides, in the present embodiment, the connecting portion 12 includes a through hole 122 extending along the axial direction and communicating with the driving hole 111 so that front portion of the tool can be received in the through hole 122 when the tool is inserted into the driving hole 111. In addition, an outer wall of the main body 10 is formed with a stepped face between the driving portion 11 and the connecting portion 12. The stepped face faces the connecting portion 12 and is opposite to the driving portion 11. Furthermore, the stepped face is perpendicular to each driven face 121. The stepped face is adapted for the wrench to abut against in order to position the wrench.

Specifically, a cross-section, which is parallel to a radial direction of the main body 10, of the notch 1212 is substantially triangle. The notch 1212 penetrates the two adjacent driven faces 121 to form a triangle opening on each of the driven faces 121. More specifically, an inner wall of the notch 1212 includes a first bottom face 12121 and a second bottom face 12122 which are connected together. Each of the first bottom face 12121 and the second bottom face 12122 is substantially triangle, and the first bottom face 12121 and the second bottom face 12122 share a bottom edge 12123. The first bottom face 12121 is closer to the driving portion 11 than the second bottom face 12122. That is to say, the first bottom face 12121 is opposite to the driving portion 11, and the second bottom face 12122 faces the driving portion 11. Please refer to FIG. 4, an angle between the first bottom face 12121 and its adjacent shared edge 1211 is defined as a first angle θ1, and an angle between the second bottom face 12122 and its adjacent edge 1211 is defined as θ2. The first angle θ1 is larger than or equal to 90 degrees. The first angle θ1 is smaller than the second angle θ2. Each of the first angle θ1 and the second angle θ2 is smaller than 180 degrees. In the present embodiment, the first angle θ1 is preferably 120 degrees, and the second angle θ2 is preferably 146 degrees. In other words, if the bottom edge 12123 is designated as the base of the first bottom face 12121 and the second bottom face 12122, the height of the first bottom face 12121 is lager than the height of the second bottom face 12122. That is, when seeing at the shared edge 1211, the first bottom face 12121 is steeper than the second bottom face 12122.

Figure 3:
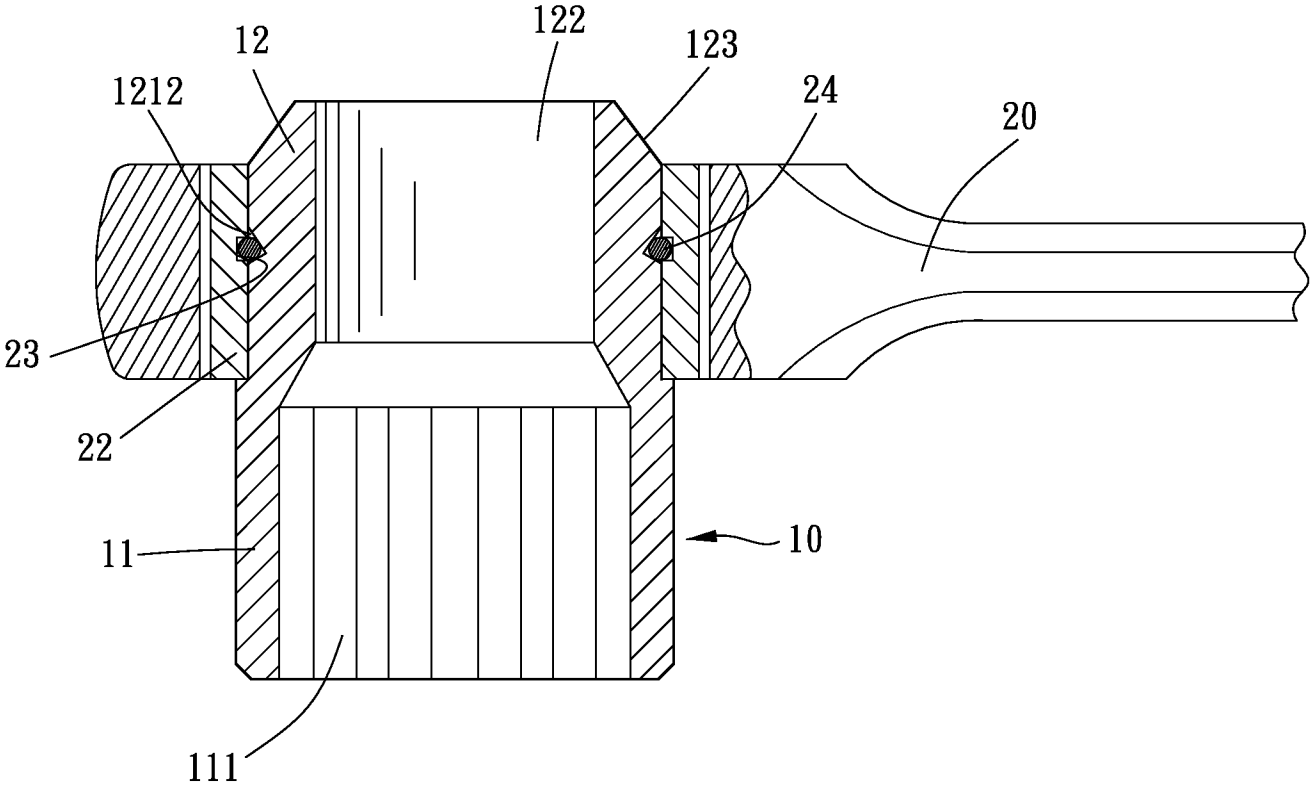
FIG. 3 is a profile showing of the present invention.
Figure 4:
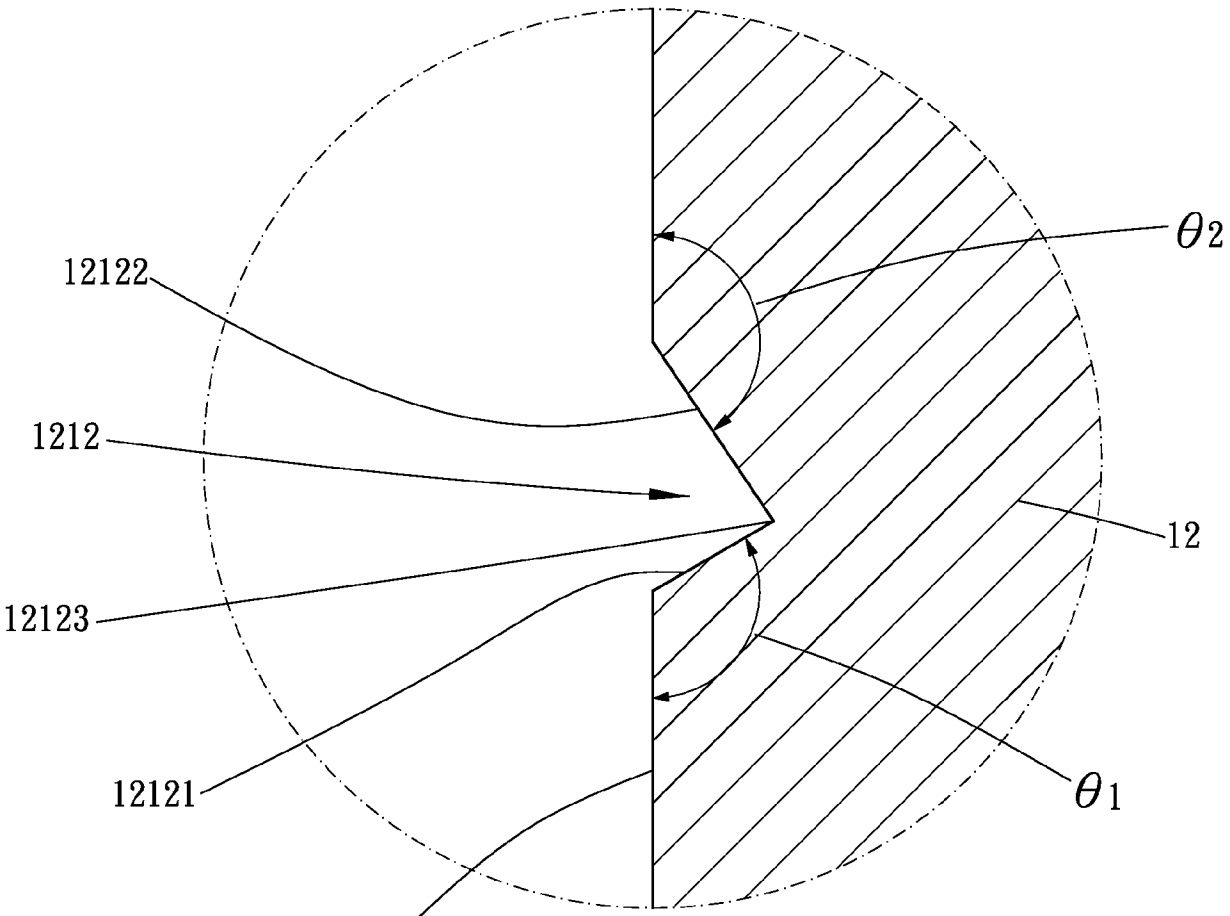
FIG. 4 is a partial profile showing of the present invention.

In use, please refer to FIGS. 3 and 4, the socket of the present invention is adapted for inserting into a sleeve hole 21 of a go-through wrench 20 wherein the inner wall of the sleeve hole 21 has a receiving portion disposed with an elastic positioning element 24. In the present embodiment, the wrench 20 is a go-through ratchet wrench with a hole disposed with a ratchet 22. The sleeve hole 21 is formed through the ratchet 22. Preferably, the sleeve hole 21 is a polygonal hole having a shape corresponding to the external surface of the main body 10 of the socket. The inner wall of the sleeve hole 21 is formed with an annular grove 23. The positioning element 24 (a C-shaped ring in the present embodiment) is received in the annular groove 23 so that the positioning element 24 is protruded into the sleeved hole 21 at angles of the sleeve hole 21. When the connecting portion 12 is going to insert into the sleeve hole 21, the chamfered face 123 helps the connecting portion 12 push the positioning element 24 off so that the connecting portion 12 can be moved forward. When the notch 1212 positionally corresponds to the positioning element 24, the positioning element 24 enters the notch 1212 and abuts against the first bottom face 12121 and the second bottom face 12122. Thereby, the socket is temporally positioned in the sleeve hole 21.

Because the first bottom face 12121 is steeper, the positioning element 24 abuts against the first bottom face 12121 much more than against the second bottom face 12122 so that the socket is prevented from moving forward further. That is, during operation, the socket is prevented from deviation with respect to the wrench so as to improve stability. On the other hand, the second bottom face 12122 slopes more gently so as to facilitate removing the socket reversely. More specifically, the second bottom face 12122 becomes a guiding face. When the socket is going to be removed from the wrench, the second bottom face 12122 helps the positioning element 24 leave the notch 1212 so that the socket can be removed easily and quickly.

In conclusion, the socket of the present invention provides a notch having special shape so as to prevent the socket from deviation. Also, the socket can be removed from the wrench easily so as to improve operation efficiency.

What is claimed is:

1. A socket, adapted for being received in a sleeve hole of a go-through wrench wherein an inner wall of the sleeve hole is formed with a receiving portion and a positioning element disposed in the receiving portion, including:

a main body, having a driving portion and a connecting portion which are located at two ends thereof along an axial direction, the driving portion being adapted for connecting with a tool, the connecting portion having an external surface which is polygonal, the external surface including a plurality of driven faces arranged around the axial direction, a shared edge being formed between every two adjacent driven faces, at least one shared edge being formed with a notch, the positioning element of the go-through wrench being received in the notch for positioning when the connecting portion is received in the sleeve hole;

wherein a cross-section, which is parallel to a radial direction of the main body, of the notch is substantially triangle, an inner wall of the notch includes a first bottom face and a second bottom face which are connected together, the first bottom face is closer to the driving portion than the second bottom face, an angle between the first bottom face and the adjacent shared edge is defined as a first angle, an angle between the second bottom face and the adjacent shared edge is defined as a second angle, the first angle is 120 degrees, the second angle is 146 degrees.

2. The socket of claim 1, wherein the driving portion includes a driving hole, the driving hole extends along the axial direction and is adapted for the tool to insert through.

3. The socket of claim 2, wherein the connecting portion includes a through hole, the through hole extends along the axial direction and communicates with the driving hole.

4. The socket of claim 1, wherein the external surface is formed with an inclined chamfered face at an end away from the driving portion so that the end of the connecting portion away from the driving portion is tapered.

5. The socket of claim 1, wherein an external wall of the main body is formed with a stepped face between the driving portion and the connecting portion, the stepped face faces the connecting portion and is opposite to the driving portion, the stepped face is perpendicular to each driven face.

* * * * *